US006516982B1

(12) United States Patent
Childers

(10) Patent No.: US 6,516,982 B1
(45) Date of Patent: Feb. 11, 2003

(54) GOLF BALL HOLDER

(76) Inventor: Frank Childers, 3742 E. Hwy. 60, Ponca City, OK (US) 74604-5499

( * ) Notice: Subject to any disclaimer, the term of this patent is extended or adjusted under 35 U.S.C. 154(b) by 0 days.

(21) Appl. No.: 09/682,125

(22) Filed: Jul. 25, 2001

(51) Int. Cl.[7] ..... A45F 5/00

(52) U.S. Cl. ..... 224/197; 224/251; 224/269; 224/918; 224/919

(58) Field of Search ..... 224/196, 251, 224/271, 919, 918, 269, 197, 666, 667, 669, 930; 206/315.9; D3/229, 257

(56) References Cited

U.S. PATENT DOCUMENTS 3,497,118 A * 2/1970 Najjar
4,850,483 A * 7/1989 Stack
5,540,368 A * 7/1996 Oliva
5,553,707 A 9/1996 Lion
5,890,638 A * 4/1999 Woloshen ..... 224/269
5,934,530 A * 8/1999 Antczak et al.
6,006,969 A * 12/1999 Kim ..... 224/197
6,168,061 B1 1/2001 Harrison
6,443,340 B1 * 9/2002 Chung et al. ..... 224/269

* cited by examiner

*Primary Examiner*—Nathan J. Newhouse
(74) *Attorney, Agent, or Firm*—Martin S. High

(57) ABSTRACT

A holder for golf balls is disclosed that is clipped to the belt or pants of a golfer. The container has a flared opening at the top and has a constricted opening at the bottom. Golf balls are placed in the top opening. The golf ball holder allows for a ball to be removed from the top opening by inserting a finger through the front opening and pushing the top golf ball out of the top flared opening. Pushing the golf ball from the bottom opening may retrieve the remaining golf ball. The golf ball holder works equally well for a right or left-handed person. Apertures are provided in the top surface of the golf ball holder to accept and securely hold golf tees and a golf ball marker. Finally, an area for advertising company or organizations names or logos is provided on the front of the golf ball holder.

2 Claims, 8 Drawing Sheets

14
15
12
12
11
13

GOLF BALL HOLDER

BACKGROUND OF INVENTION

This invention relates to holding golf balls in an accessible, portable manner that may be carried on the golfer's belt, pocket, or pants or attached to the golf bag. When playing a game of golf, it is very common to lose a golf ball or desire to change to a clean golf ball. Usually the golfer must reach into their pants or jacket pocket or the accompanying golf bag to retrieve a new golf ball. This tends to disrupt a golfer's concentration and is disruptive to the golfer. Further, when a golfer plays on a wet day or early in the morning with dew on the grass, the golf balls typically become very wet. Most golfers carry their golf balls in their pants or jacket pocket. Unfortunately, this typically makes the pants or jacket pocket very damp and soiled from the dirt, grass and water that accumulate on the golf ball thereby wetting, soiling and staining the clothing. Finally, many golf ball holders are fixed to the pants or belt such that when a golfer bends over, the golf ball holder tilts significantly enough for the golf balls to fall out of the golf ball holder.

The objective of the instant invention is to solve these problems by keeping golf balls in a convenient easily accessible location and not come into direct contact with clothing and eliminating the need for repeated use of the pants or jacket pockets. Further, an additional objective of the instant invention is to provide a golf ball holder that is easy to use, entails a modern and unique design, and stores the golf balls in a secure, yet readily accessible fashion. Finally, the golf ball holder must be rugged, lightweight, and an attractive golf accessory.

Other golf ball holders have been proposed and implemented. The closest in the art, as disclosed in U.S. Pat. No. 5,553,707 issued to Lion on Sep. 10, 1996, was devised to hold golf balls in a container consisting of a top and bottom connected by three elongated elements. A major drawback of this device is that the ball must be placed into the holder by pushing a golf ball through two of the elongated elements, thereby pushing two of the elongated elements in such a manner as to produce an opening large enough to allow the golf ball to enter. This is a difficult procedure that makes the holder impractical to use, and may cause the Lion golf ball holder to break.

Other previous art includes U.S. Pat. No. 6,168,061 issued to Harrison on Jan. 2, 2001. Harrison teaches a tray section formed integrally with a leg section. The golf balls are contained in the tray section of the invention and the leg section attaches the golf ball holder to the belt. A major drawback of Harrison is that the golf balls are not securely contained as in the instant invention. If the golfer bends down the Harrision invention would tilt and allow the golf balls to disengage. Further, the Harrison invention is significantly extended from the golfer"s body and would be uncomfortable to the golfer.

SUMMARY OF INVENTION

The instant invention is a portable golf ball holder, comprising: a flared, elongated, slightly flattened, hollow, cylindrical enclosure having a top surface, a bottom surface, a front surface, and a back surface. The golf ball holder is most commonly manufactured from polymer or polymer composite materials. The top surface forms a oblong top opening slightly larger in diameter than that of a regulation golf ball, and the bottom surface forms a bottom opening slightly smaller than that of a regulation golf ball. The back surface contains a circular extension that protrudes from the back surface and can be engaged into various commercially available belt clips commonly used to secure cellular telephones to the trousers either at the waistband of the trousers or the belt. The front surface of the instant invention contains an area that can be used to affix advertising for a company or organization.

The instant invention also is comprised of a custom belt clip, which has a front leg, a back leg, and a bridge that integrally and hingedly connects the front leg with the back leg. The front leg forms two circular apertures that can receive the circular extension from the golf ball holder. On the inside portion of the front leg, a small lip is formed that aids in securing the belt clip to the clothing of the wearer. The clip is removed from the belt by squeezing the top portion of the front and back legs together to open the bottom portions of the front and back legs. The back leg is slightly longer than the front leg. The back leg securely fits around the belt or inside the waistband of the wearer.

DETAILED DESCRIPTION

Figure 1:
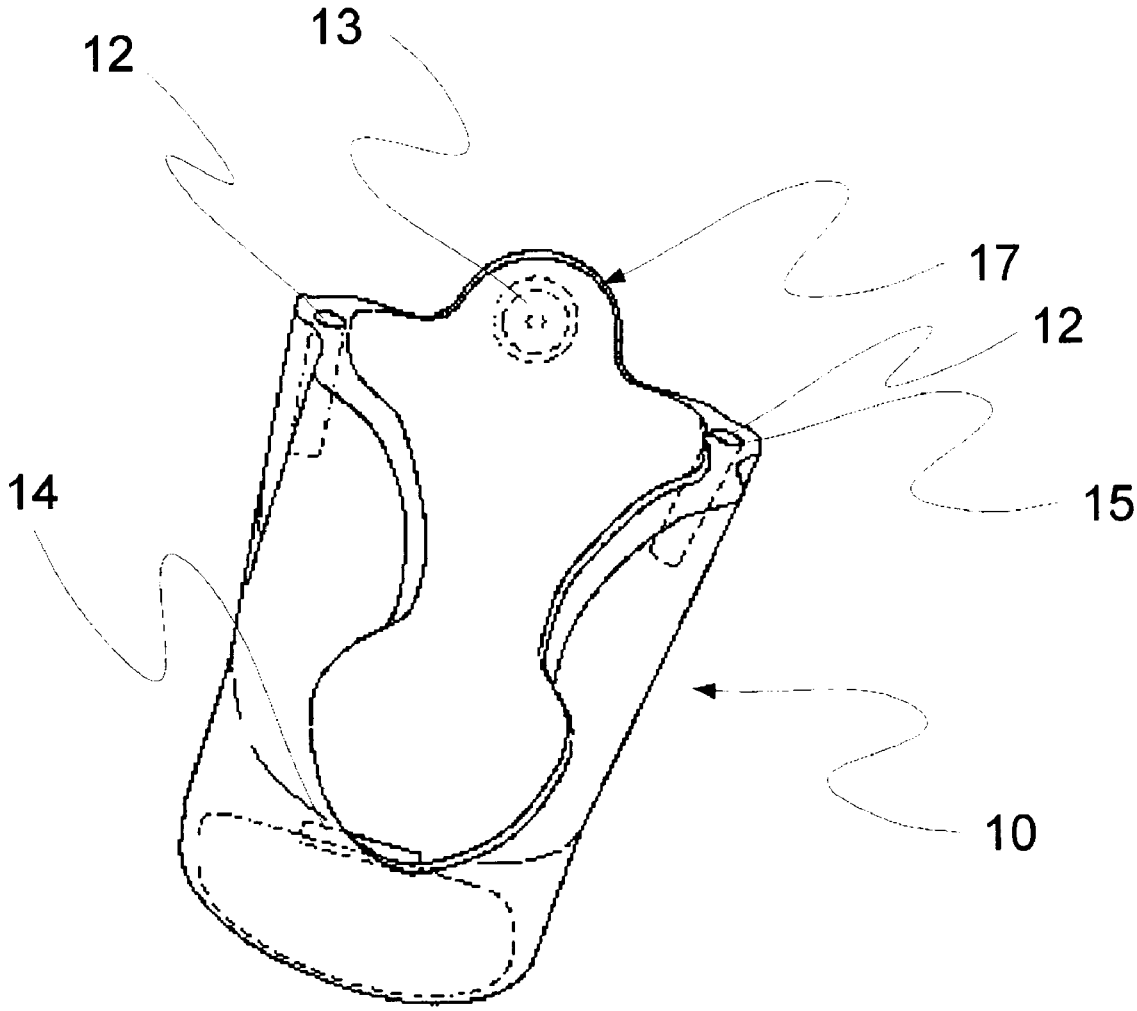
FIG. 1 is a front view of the golf ball holder at a tilted angle.
Figure 2:
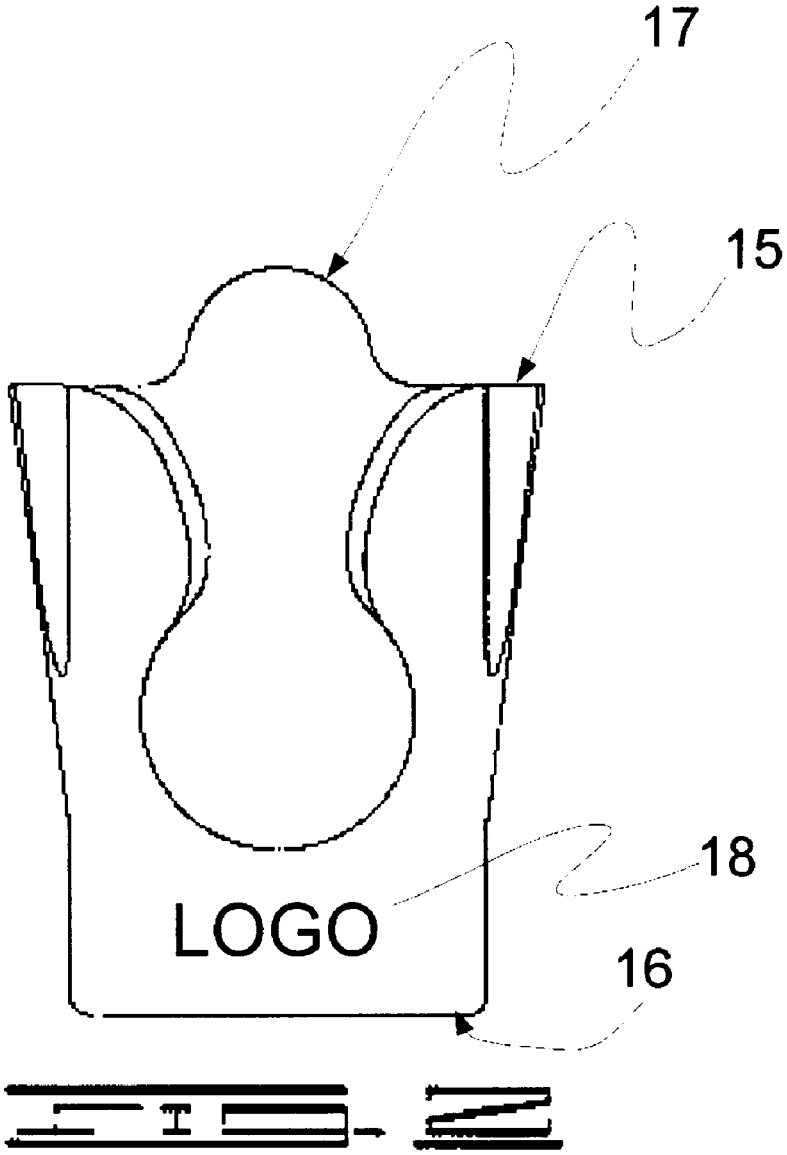
FIG. 2 is a straight front view of the golf ball holder.
Figure 3:
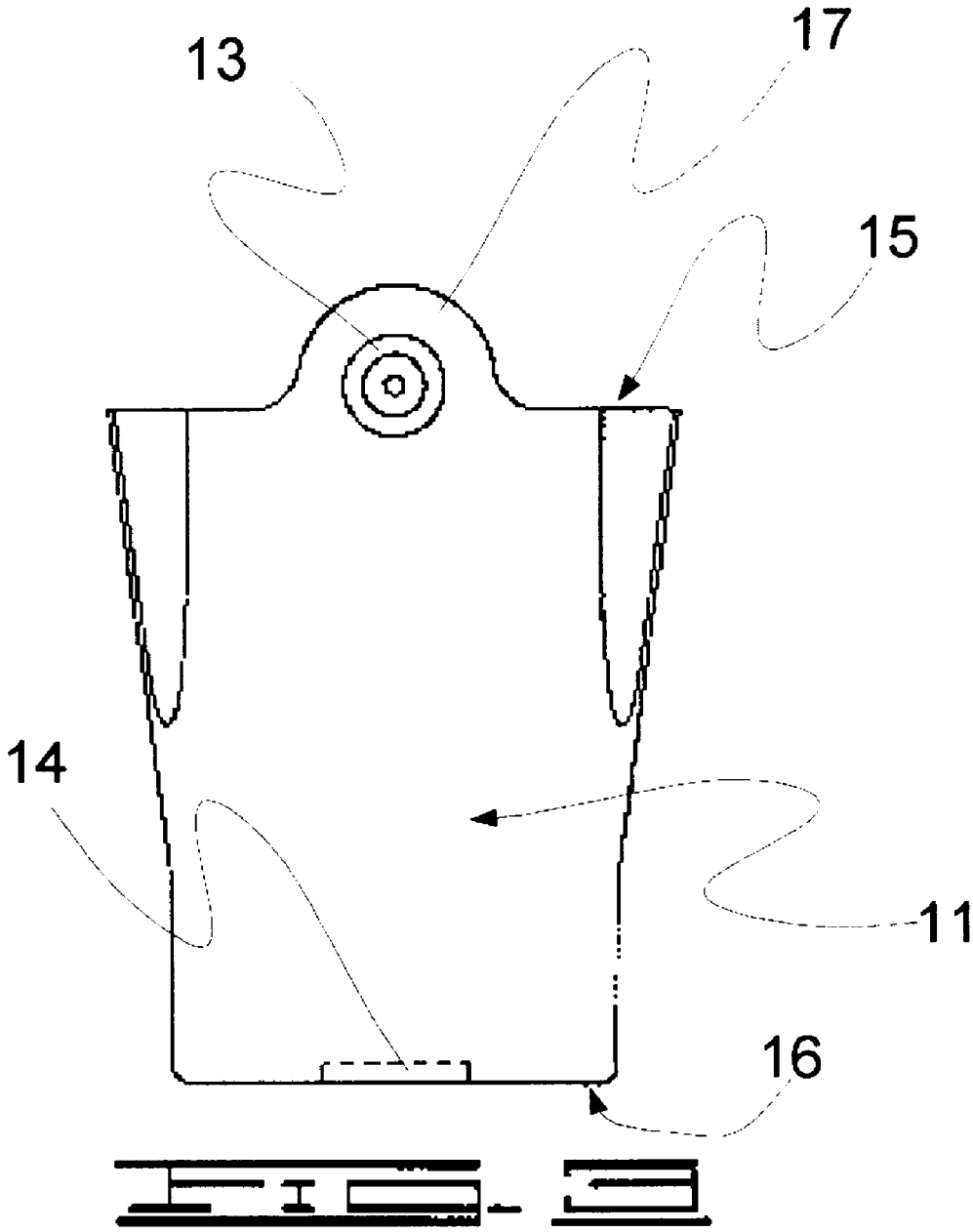
FIG. 3 is a back view of the golf ball holder showing the back surface.
Figure 4:
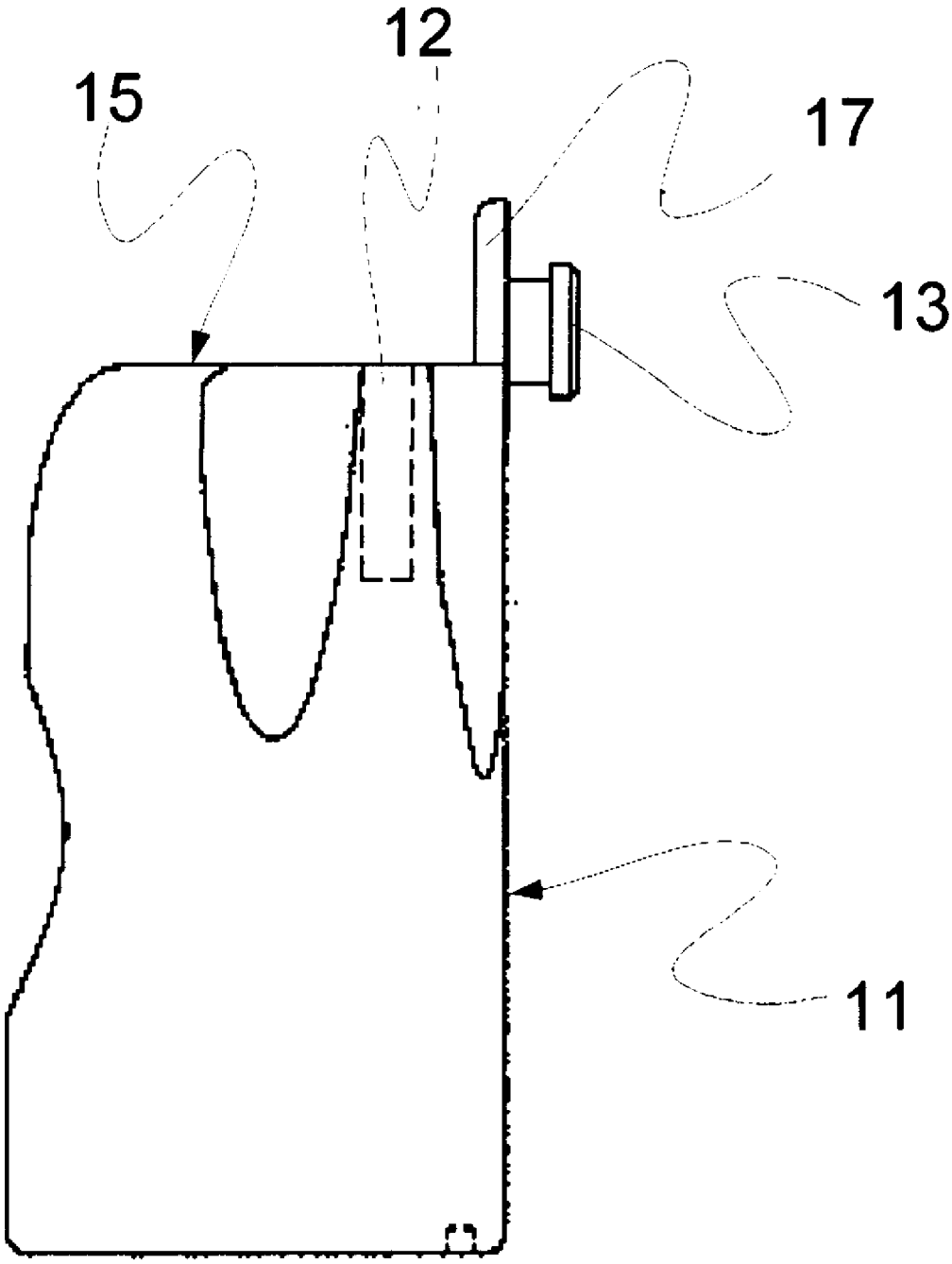
FIG. 4 is a right view of the golf ball holder.
Figure 5:
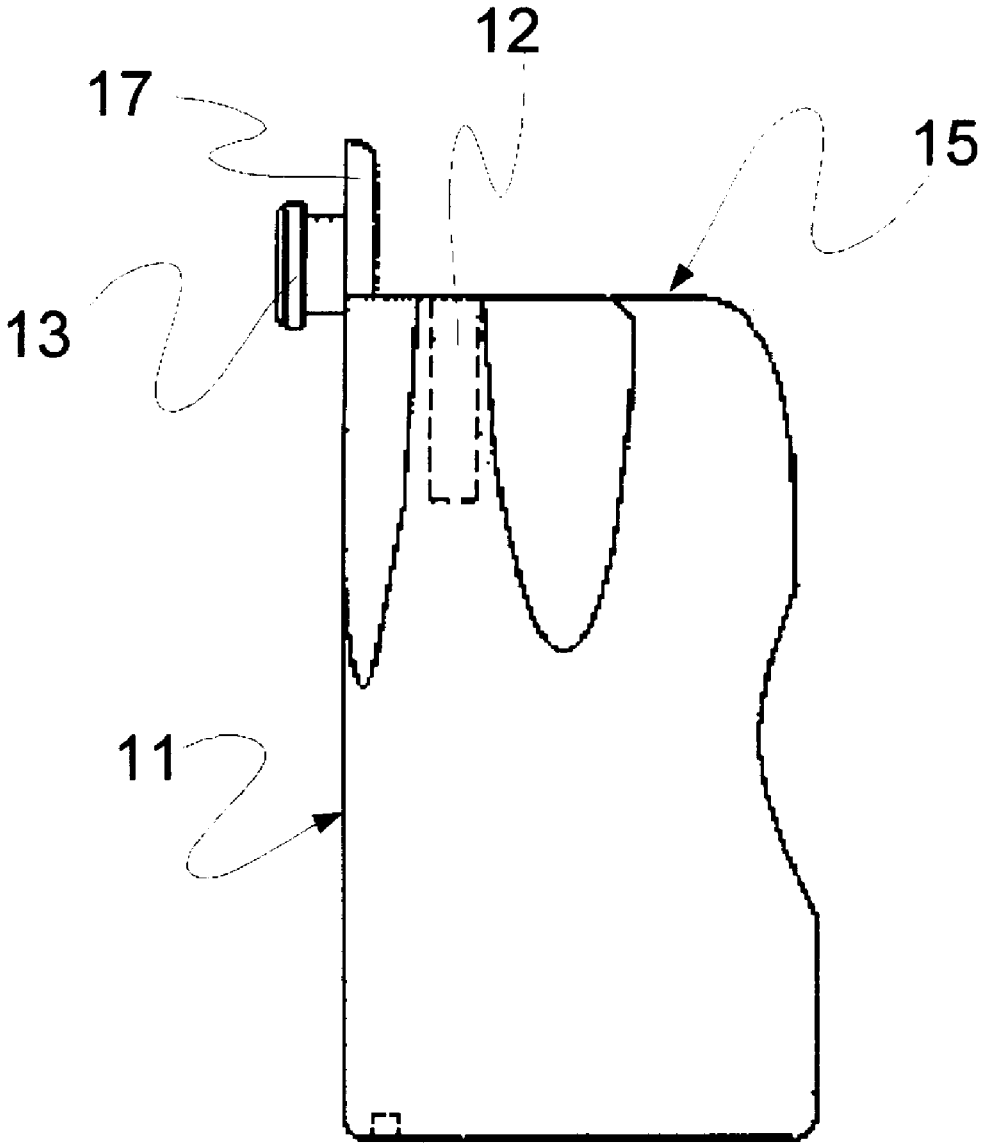
FIG. 5 is a left view of the golf ball holder.
Figure 6:
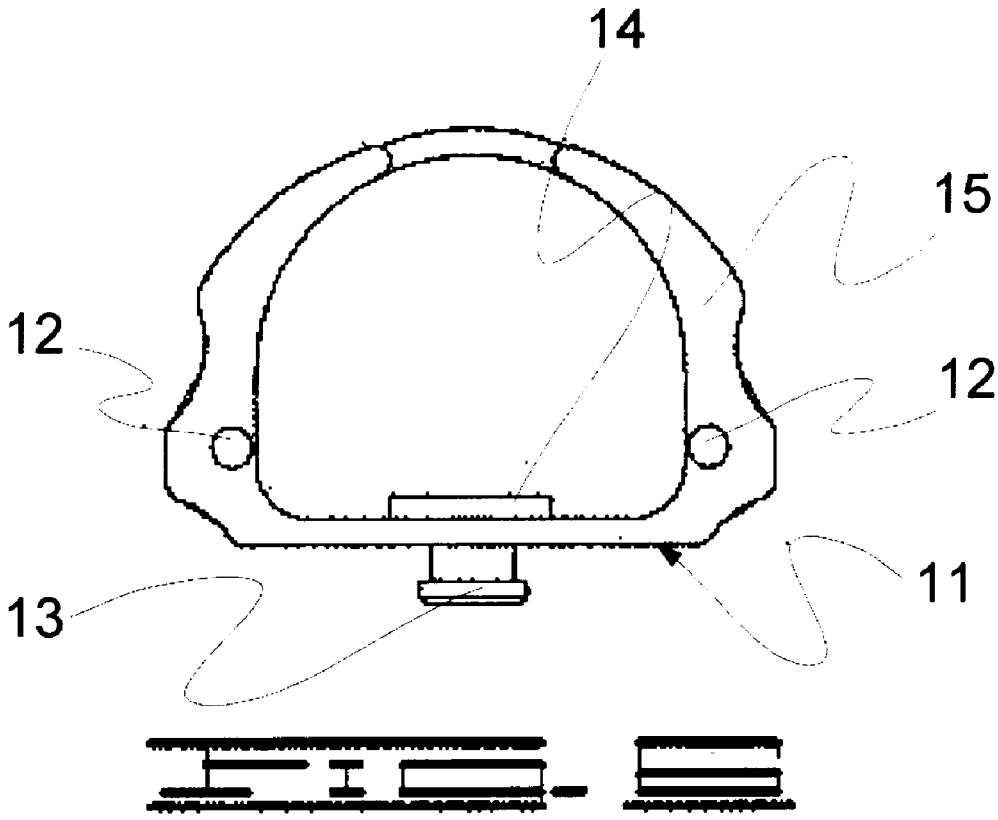
FIG. 6 is a top view of the golf ball holder.
Figure 7:
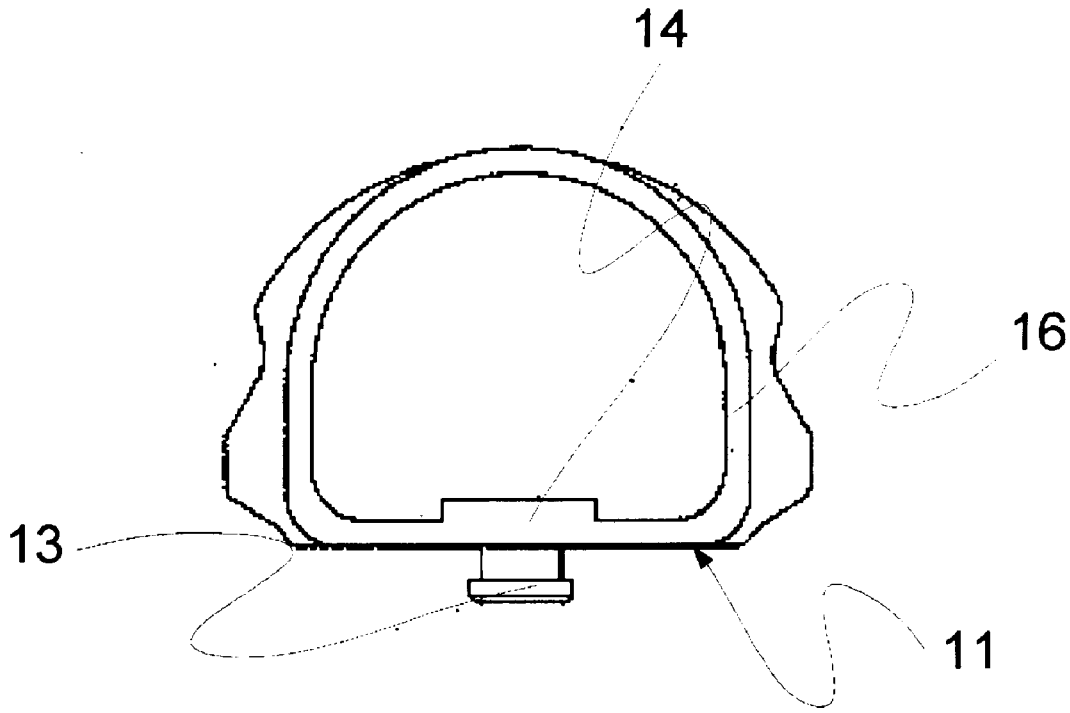
FIG. 7 is a bottom view of the golf ball holder.

With the objectives of the invention in mind, and with the purpose of the invention as embodied and broadly described herein, a portable golf ball holder 10 is provided, comprising: a flared, elongated, slightly flattened, hollow, cylindrical enclosure having a top surface 15 and a bottom surface 16. The golf ball holder can be manufactured from a variety of materials, but most commonly is manufactured from blow molded polymer, injection molded polymer or polymer composite materials. The top surface 15 forms an oblong top opening with the minor axis slightly larger in diameter than that of a regulation golf ball thereby allowing easy insertion of a regulation golf ball through the top opening. The bottom surface 16 forms a bottom opening slightly smaller than that of a regulation golf ball. The bottom surface is flat so that the golf ball holder stands upright when placed on a flat surface.

The slightly flattened shape of the slightly flattened, hollow, cylindrical enclosure forms a back surface 11 that is flattened so that the enclosure can be comfortably worn against the body of the golfer or mounted flush against an inanimate object, such as a golf bag.

The top surface contains a vertical extension 17 that protrudes from the top rear portion of the top surface. The vertical extension also forms an extension of the back surface. The back surface contains a circular extension 13 that protrudes from the back surface that can be engaged into various commercially available belt clips commonly used to secure cellular telephones to the trousers either at the waistband of the trousers or the belt or engaged with a clip specifically designed to be used with the instant invention. The top surface may form apertures that may accept and securely hold a golf ball marker.

The top surface 15 of the enclosure that forms the top opening is an approximately circular surface flattened on the back. The top surface also forms two apertures 12 that can each separately receive and securely hold a golf tee.

The bottom surface 16 that forms the bottom opening is an approximately circular surface flattened on the back. The bottom surface also contains a horizontal lip 14 that insures the golf balls remain in the enclosure by providing a stop to prevent the golf ball from falling out the bottom of the enclosure. The front surface contains an area 18 that can be used to advertise a company, business or organization by printing or labeling that particular company, business or organization's logo or name directly onto the surface on the front bottom area reserved to be used exclusively for advertising purposes. This name can be permanently or interchangeably affixed onto that advertising area.

The instant invention is designed to be used with commercially available belt clips commonly available for attaching cellular phones to the belt of the user. However, there are some disadvantages of using some of these belt clips with the golf ball holder. For example, some of the clips are small and not capable of comfortably holding the weight of the golf ball holder and two golf balls. Therefore, a custom designed belt clip has been invented to accompany the golf ball holder. This custom belt clip is shown in FIG. 8.

Figure 8:
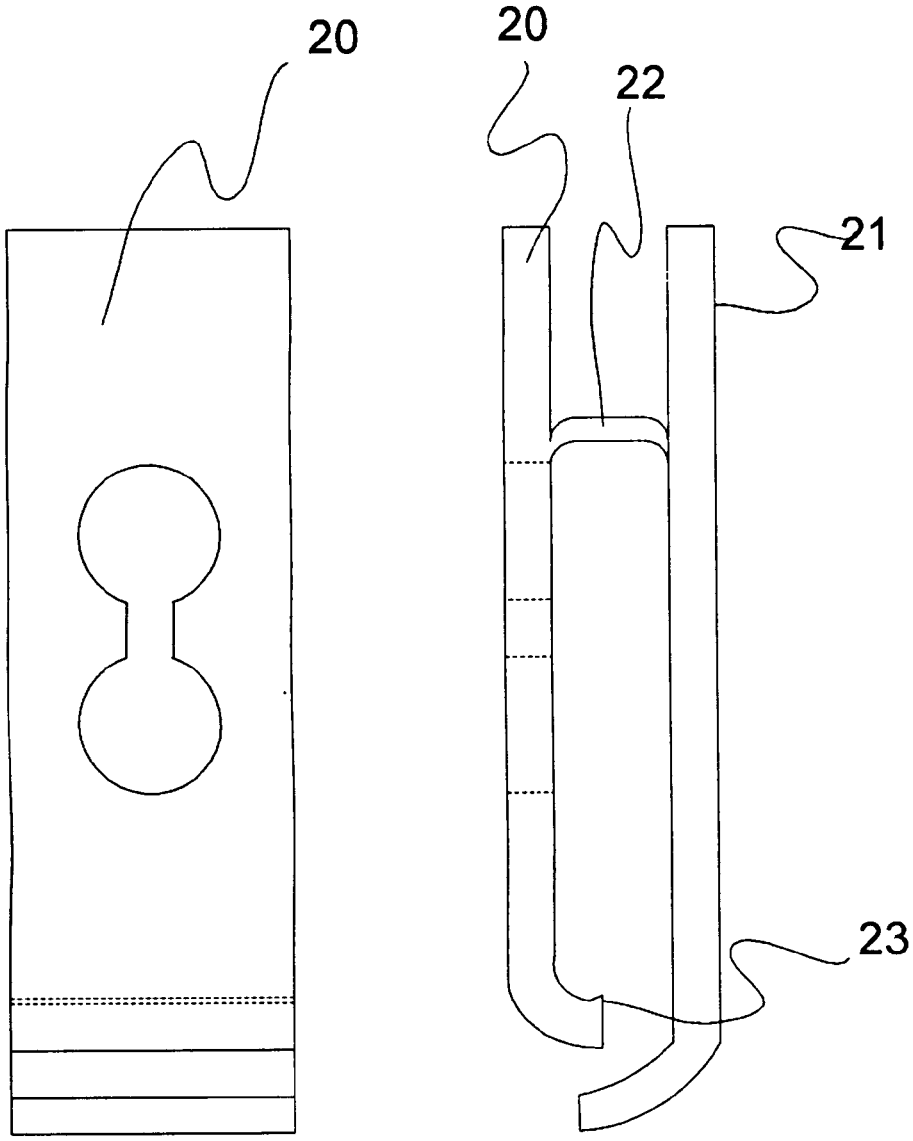
FIG. 8 is a front and side view of a custom belt clip for the golf ball holder.

The custom belt clip, given in FIG. 8, has a front leg 20, a back leg 21, and a bridge 22 that hingedly connects the front leg with the back leg. The front leg forms two circular apertures that can receive the circular extension 13 from the golf ball holder. The front leg also forms a rectangular shaped aperture that connects the two circular apertures. The bottom of the front leg contains a curvature resulting in the bottom portion of the front leg becoming essentially perpendicular to the main portion of the front leg. The bottom of the rear leg contains a curvature resulting in the bottom portion of the rear leg forming an angle of between 45 and 90 degrees to the main portion of the rear leg. On the inside portion of the front leg, a small lip 23 is formed that aids in securing the belt clip to the clothing of the wearer. The clip is removed from the belt by squeezing the top portion of the front and back legs together to open the bottom portions of the front and back legs. The back leg 17 is slightly longer than the front leg 20. The back leg securely fits around the belt or inside the waistband of the wearer. The bridge 22 is manufactured from resilient plastic material which allows the user to compress the top portion of the front and back legs thereby opening the bottom of the front and back legs allowing the clip to be placed over the belt, pocket or waistband of the user.

The instant invention is best used by affixing the holder to a custom made or commercial belt clip and in turn affixing the clip to the belt or waistband of the golfer. The golfer stores golf balls in the clip by dropping two balls into the opening formed by the top surface 15. When a golf ball is needed, the golfer places his finger into the opening formed by the bottom surface 16 thereby pushing the golf ball out through the opening formed by the top surface. A company logo or other advertisement can be placed on the area 18 on the front surface.

What is claimed is:

1. A portable golf ball holder comprising:

a flared, elongated, slightly flattened, nearly cylindrical enclosure;

a top surface forming an oblong top opening with a slightly flattened back surface with a minor axis slightly larger than that of the diameter of a regulation golf ball thereby allowing easy insertion of a regulation golf ball through the said top opening;

a bottom surface forming a nearly circular bottom opening slightly smaller than that of a regulation golf ball;

a front surface forming a front opening smaller than a regulation golf ball;

the bottom opening located wherein a finger can be inserted through the bottom opening to force a golf ball through the top opening into the palm of that hand thereby allowing for removal of a regulation golf ball using only one hand by either a left or right-handed person;

the cylindrical enclosure forming a slightly flattened back surface with a vertical extension formed integrally with the top rear portion of the top surface and the top portion of the slightly flattened back surface;

the vertical extension forming an extension of the back surface which can be used to suspend the golf ball holder in a rotatable manner;

the vertical extension containing a circular extension that protrudes from the back surface engaged into a belt clip so that the golf ball holder is suspended via the vertical extension in a rotatable manner the belt clip is comprised of a front leg and a back leg that are hingedly connected with a bridge that allows the front leg and said back leg to be compressed at one end thereby expanding the opening at the opposite end;

the bottom portion of the front leg forms a curvature allowing the bottom portion of the front leg to be essentially perpendicular to the top portion of the front leg;

the said bottom portion of the front leg forming a lip that allows for a secure interference fit with the belt or waistband of the user;

the bottom portion of the back leg forms a curvature forming an angle of between 45 degrees and 90 degrees with the top portion of the leg.

2. The golf ball holder according to claim 1 wherein the front surface contains permanent or interchangeably affixed indicia.

* * * * *